US010260729B2

(12) United States Patent
Fortin

(10) Patent No.: US 10,260,729 B2
(45) Date of Patent: Apr. 16, 2019

(54) LED LIGHTING FIXTURE

(71) Applicant: LUMCA INC., Québec (CA)

(72) Inventor: Luc Fortin, Québec (CA)

(73) Assignee: LUMCA INC., Quebec (CA)

( * ) Notice: Subject to any disclaimer, the term of this patent is extended or adjusted under 35 U.S.C. 154(b) by 0 days.

(21) Appl. No.: 15/636,085

(22) Filed: Jun. 28, 2017

(65) Prior Publication Data

US 2018/0202644 A1 Jul. 19, 2018

Related U.S. Application Data

(60) Provisional application No. 62/446,678, filed on Jan. 16, 2017.

(51) Int. Cl.

| | |
|---|---|
| ***F21V 29/00*** | (2015.01) |
| ***F21V 29/74*** | (2015.01) |
| ***F21V 29/83*** | (2015.01) |
| ***F21V 15/01*** | (2006.01) |
| ***F21V 23/00*** | (2015.01) |
| ***F21V 29/71*** | (2015.01) |
| *F21V 29/89* | (2015.01) |

(Continued)

(52) U.S. Cl.

CPC ..... *F21V 29/74* (2015.01); *F21V 15/01* (2013.01); *F21V 23/003* (2013.01); *F21V 23/009* (2013.01); *F21V 29/713* (2015.01); *F21V 29/83* (2015.01); *F21V 29/89* (2015.01); *F21W 2131/103* (2013.01); *F21Y 2105/10* (2016.08); *F21Y 2115/10* (2016.08)

(58) Field of Classification Search

None

See application file for complete search history.

(56) References Cited

U.S. PATENT DOCUMENTS

| | | | |
|---|---|---|---|
| 6,404,637 | B2 | 6/2002 | Hutchison et al. |
| 6,719,446 | B2 | 4/2004 | Cao |

(Continued)

OTHER PUBLICATIONS

Thorn Lighting People, HiPak, <http://www.thornlighting.com/en/products/new-products/hipak>, Sep. 2016.

(Continued)

*Primary Examiner* — Christle I Marshall

(74) *Attorney, Agent, or Firm* — Marshall, Gerstein & Borun LLP

(57) ABSTRACT

A LED Lighting fixture including a first and a second heat sink section made of high thermal conductivity material and a LED assembly. The first heat sink section includes a closed outer wall defining a housing cavity; and a plurality of first projections projecting inwardly into the housing cavity. The second heat sink section is engageable and securable with the first heat sink section and includes a LED support including a LED engaging wall and a plurality of second projections projecting from an inner surface thereof. At least one of the second projections physically engage a corresponding one of the first projections to define a thermal bridge therebetween, when the first and second heat sink sections are engaged. The LED assembly is engageable with the second heat sink section and is in thermal engagement with the LED engaging wall thereof when engaged with the second heat sink section.

18 Claims, 7 Drawing Sheets

(51) Int. Cl.

| | |
|---|---|
| *F21Y 115/10* | (2016.01) |
| *F21W 131/103* | (2006.01) |
| *F21Y 105/10* | (2016.01) |

(56) References Cited

U.S. PATENT DOCUMENTS

| | | | | |
|---|---|---|---|---|
| 7,874,702 | B2 * | 1/2011 | Shuai | F21K 9/00 362/294 |
| 7,874,710 | B2 | 1/2011 | Tsai et al. | |
| 8,047,674 | B2 | 11/2011 | Liu | |
| 8,092,049 | B2 | 1/2012 | Kinnune et al. | |
| 8,203,274 | B2 | 6/2012 | De Castro | |
| 8,240,885 | B2 | 8/2012 | Miller | |
| 8,322,892 | B2 | 12/2012 | Scordino et al. | |
| 8,414,178 | B2 | 4/2013 | Alexander et al. | |
| 8,434,906 | B2 | 5/2013 | Arik et al. | |
| 8,632,213 | B2 | 1/2014 | Patkus et al. | |
| 8,692,444 | B2 | 4/2014 | Patel et al. | |
| 9,228,733 | B2 | 1/2016 | Stolte et al. | |
| 9,657,933 | B2 * | 5/2017 | Clark | F21V 29/763 |
| 2010/0242519 | A1 | 9/2010 | Breidenassel et al. | |
| 2013/0092362 | A1 | 4/2013 | Chen | |
| 2014/0146555 | A1 * | 5/2014 | Choi | F21S 41/19 362/512 |
| 2015/0219331 | A1 * | 8/2015 | Clark | F21V 29/763 362/364 |
| 2016/0178183 | A1 | 6/2016 | Guercio et al. | |

OTHER PUBLICATIONS

RH752 LED Lighting Fixture, Ronghua Industries, <http://www.rhlight.com/RH752_LED_LIGHTING_FIXTURE_566.html>, Mar. 2015.

* cited by examiner

LED LIGHTING FIXTURE

CROSS REFERENCE TO RELATED APPLICATION

This application claims the benefit under 35 U.S.C. § 119(e) of United States provisional patent application Ser. No. 62/446,678 which was filed on Jan. 16, 2017. The entirety of the aforementioned application is herein incorporated by reference.

TECHNICAL FIELD OF THE INVENTION

The present invention relates to the field of light-emitting diode (LED) lighting fixtures. More particularly, it relates to a LED lighting fixture designed and configured to prevent overheating, while providing physical protection of the LED assembly and preventing infiltration and/or accumulation of water, dust and debris into the housing of the LED lighting fixture.

BACKGROUND

Numerous LED lighting fixtures of distinct configurations and designs are known in the art. Given the sensitivity of the LED assembly of LED lighting fixtures to high heat, one major challenge regarding such LED lighting fixtures relate to thermal management, i.e. relates to the dissipation of the heat generated by the LED assembly of the LED lighting fixture. Indeed, to maximize lighting performance and life span of the LED assembly, the LED lighting fixture is generally required to offer efficient dissipation of the excess heat generated by the LED assembly.

In view of the above, LED lighting fixtures usually include a heat sink made of high thermal conductivity material and designed to transfer the heat generated by the LED assembly to a fluid medium, such as the outside air surrounding the lighting fixture, by heat conduction. For example, it is known to provide a LED lighting fixture having a single piece housing operating as heat sink. For example, the housing can include an outer wall integral with heat conduction fins extending between the outer wall of the housing and the LED assembly (or a support thereof). However, such single piece design of the housing operating as heat sink of the LED lighting fixture tend to suffer from several drawbacks. For example and without being limitative, if produced by extrusion, the design of the single piece housing is very limited in design options. Moreover, if produced by casting the single piece housing generally must have an open top design (i.e. either include exposed fins on the top of the fixture or an open cover covering the fins on top of the fixture) which allows undesirable accumulation of water, dust and debris into the housing of the LED lighting fixture.

In view of the above, there is a need for an improved LED lighting fixture which, by virtue of its design and components, would be able to overcome or at least minimize some of the above-discussed prior art concerns.

BRIEF SUMMARY OF THE INVENTION

In accordance with a first general aspect, there is provided a LED lighting fixture. The LED lighting fixture comprises a first heat sink section, a second heat sink section and a LED assembly. The first heat sink section is made of high thermal conductivity material and includes a closed outer wall defining a housing cavity and having an inner surface;

and a plurality of first heat sink projections projecting inwardly into the housing cavity from the inner surface of the closed outer wall. The second heat sink section is made of high thermal conductivity material and is engageable with the first heat sink section and securable to the first heat sink section. It includes a LED support including a LED engaging wall having an inner surface and a plurality of second heat sink projections projecting from the inner surface of the LED engaging wall of the LED support. At least one of the plurality of second heat sink projections physically engage a corresponding one of the plurality of first heat sink projections to define a thermal bridge therebetween, when the first heat sink section and the second heat sink section are engaged with one another. The LED assembly is engageable with the second heat sink section and is in thermal engagement with the LED engaging wall of the second heat sink section when engaged with the second heat sink section.

In an embodiment, the plurality of first heat sink projections and the plurality of second heat sink projections are spaced apart from one another. Air circulation channels are defined between connected ones of the plurality of first heat sink projections and the plurality of second heat sink projections, when the first heat sink section and the second heat sink section are engaged with one another.

In an embodiment, the LED lighting fixture further comprises at least one airflow port at least partially surrounding the LED support, when the first heat sink section and the second heat sink section are engaged with one another, the at least one airflow port allowing airflow through the air circulation channels.

In an embodiment, the first heat sink section and the second heat sink section extend longitudinally along a longitudinal axis and the plurality of first heat sink projections and the plurality of second heat sink projections are each substantially aligned with a lateral plane being defined substantially perpendicularly to the longitudinal axis.

In an embodiment, the closed outer wall of the first heat sink section has a width and each one of the plurality of first heat sink projections projects from the inner surface of the closed outer wall along substantially the entire width thereof.

In an embodiment, the LED engaging wall of the LED support of the second heat sink section has a width and each one of the plurality of second heat sink projections projects from the inner surface of the LED engaging wall along substantially the entire width thereof.

In an embodiment, at least a section of the plurality of first heat sink projections and the plurality of second heat sink projections overlap over an overlapping section, when the first heat sink section and the second heat sink section are engaged with one another.

In an embodiment, the at least one of the plurality of second heat sink projections is connectable to the corresponding one of the plurality of first heat sink projections along a lateral surface of at least a portion of the overlapping section.

In an embodiment, each one of the plurality of first heat sink projections is connectable to a corresponding one of the plurality of second heat sink projections, to define the thermal bridge between the first heat sink section and the second heat sink section, when the first heat sink section and the second heat sink section are engaged with one another.

In accordance with another general aspect, there is also provided a LED lighting fixture. The LED lighting fixture comprises a housing having an outer wall made of high thermal conductivity material and defining a housing cavity with a cavity inlet, the outer wall having an inner surface; a plurality of first heat conductive projections projecting from the inner surface of the closed outer wall of the housing and into the housing cavity; a LED support engageable with the housing, the LED support including a LED engaging wall made of high thermal conductivity material and having an inner surface and an outer surface; a plurality of second heat conductive projections projecting from the inner surface of the LED engaging wall of the LED support, at least one of the plurality of second heat conductive projections being physically engageable with a corresponding one of the plurality of first heat conductive projections to define a thermal bridge between the outer wall of the housing and the LED engaging wall of the LED support, when the LED support is engaged with the housing; and a LED assembly engageable with the outer surface of the LED engaging wall of the LED support, the LED assembly being in thermal connection with the LED support when engaged with the outer surface of the LED engaging wall of the LED support.

In an embodiment, the plurality of first heat conductive projections and the plurality of second heat conductive projections are spaced apart from one another. Air circulation channels are defined between the connected ones of the plurality of first heat conductive projections and the plurality of second heat conductive projections, when the LED support is engaged with the housing.

In an embodiment, the LED lighting fixture further comprises at least one airflow port at least partially surrounding the LED engaging wall of the LED support, when the LED support is engaged with the housing, the at least one airflow port allowing airflow through the air circulation channels.

In an embodiment, the housing and the LED support extend longitudinally along a longitudinal axis and the plurality of first heat conductive projections and the plurality of second heat conductive projections are each substantially aligned with a lateral plane being defined substantially perpendicularly to the longitudinal axis.

In an embodiment, the outer wall of the housing has a width and each one of the plurality of first heat conductive projections projects from the inner surface of the outer wall along substantially the entire width thereof.

In an embodiment, the LED engaging wall of the LED support has a width and each one of the plurality of second heat conductive projections projects from the inner surface of the LED engaging wall of the LED support along substantially the entire width thereof.

In an embodiment, at least a section of the plurality of first heat conductive projections and the plurality of second heat conductive projections overlap over an overlapping section, when the LED support is engaged with the housing.

In an embodiment, the at least one of the plurality of second heat conductive projections is connectable to the corresponding one of the plurality of first heat conductive projections along a lateral surface of at least a portion of the overlapping section.

In an embodiment, each one of the plurality of first heat conductive projections is connectable to a corresponding one of the plurality of second heat conductive projections to define the thermal bridge between the outer wall of the housing and the LED engaging wall of the LED support, when the LED support is engaged with the housing.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
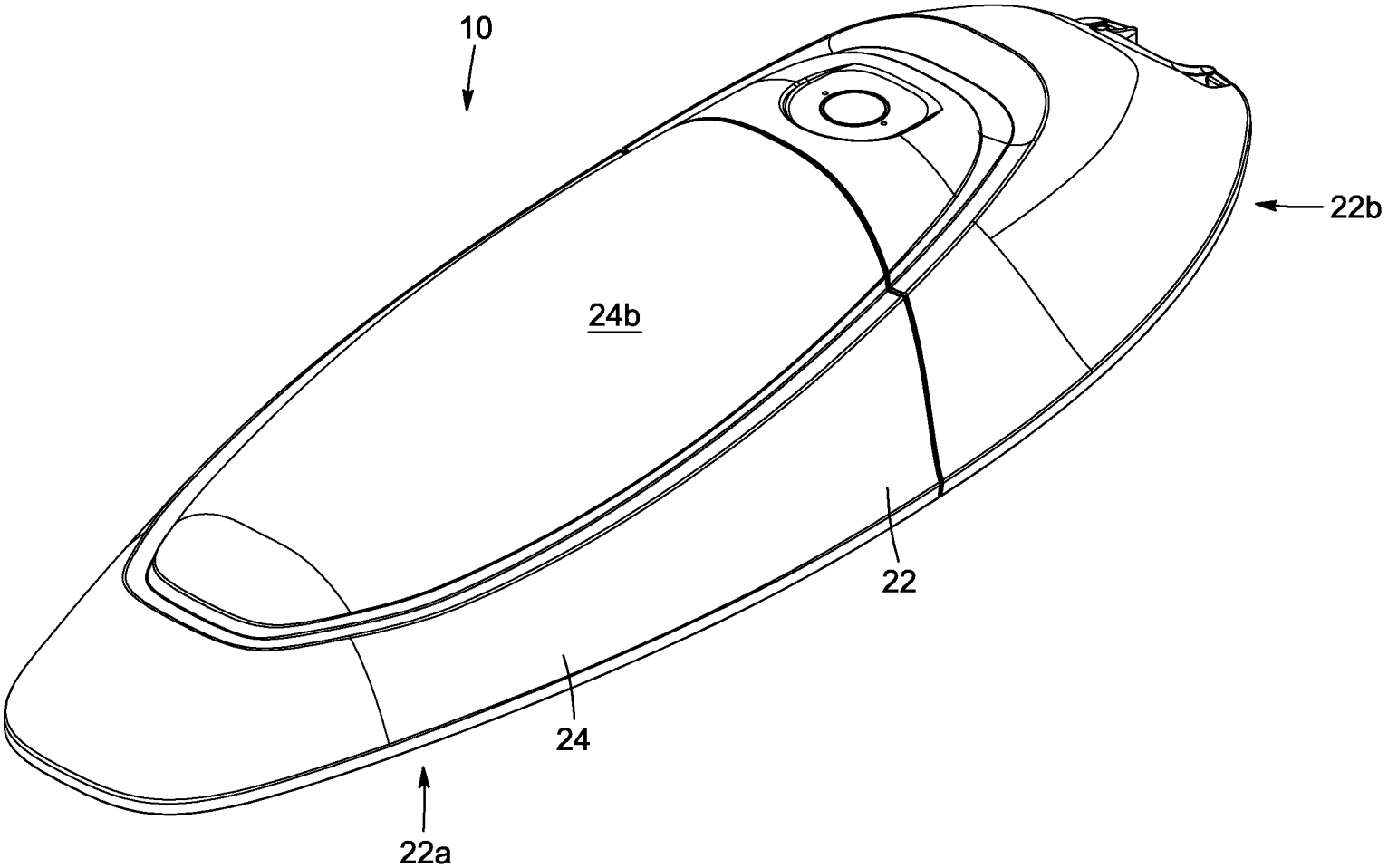
FIG. 1 is a top isometric view of the LED lighting system, in accordance with an embodiment.
Figure 2:
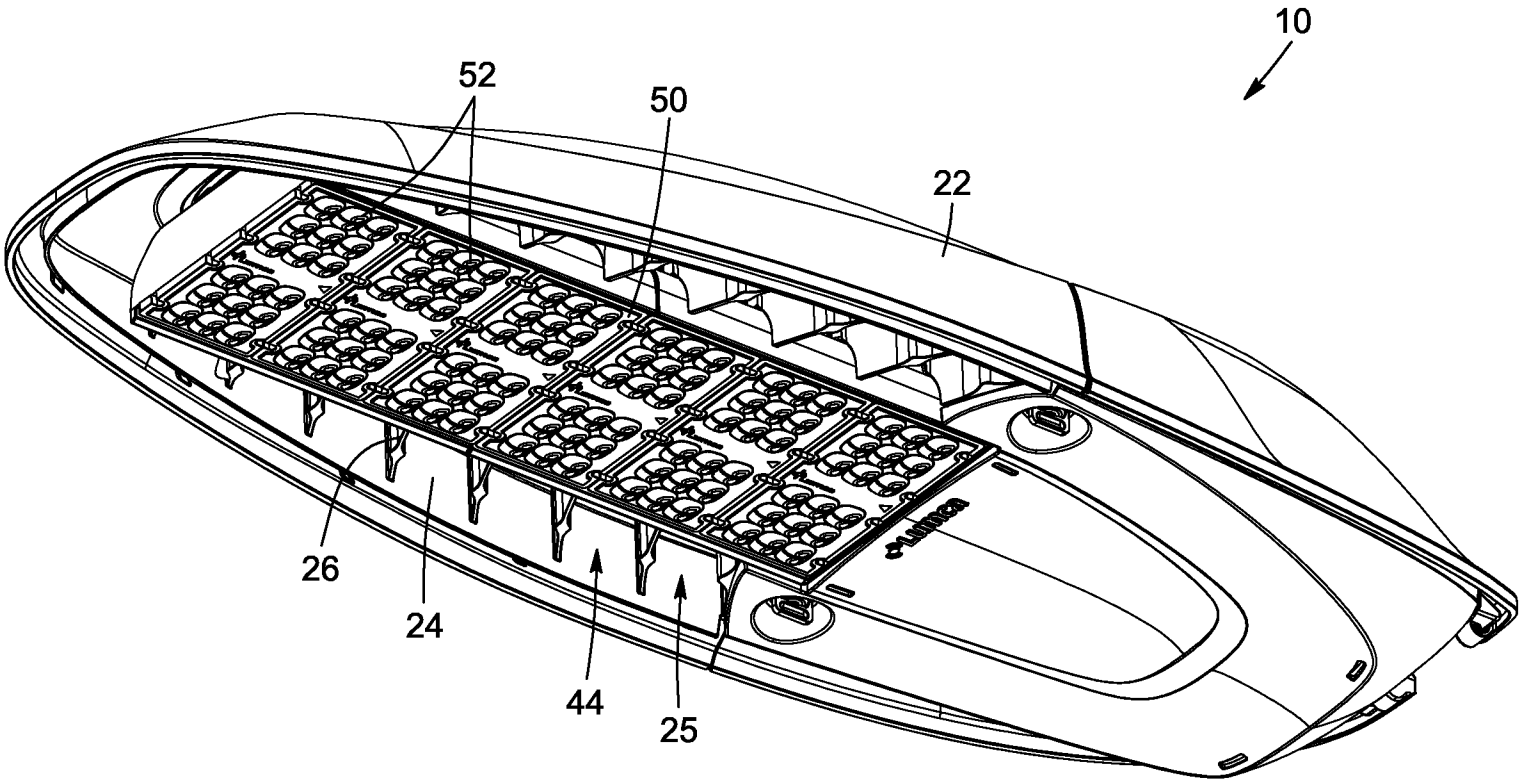
FIG. 2 is a bottom isometric view of the LED lighting system of FIG. 1.
Figure 3:
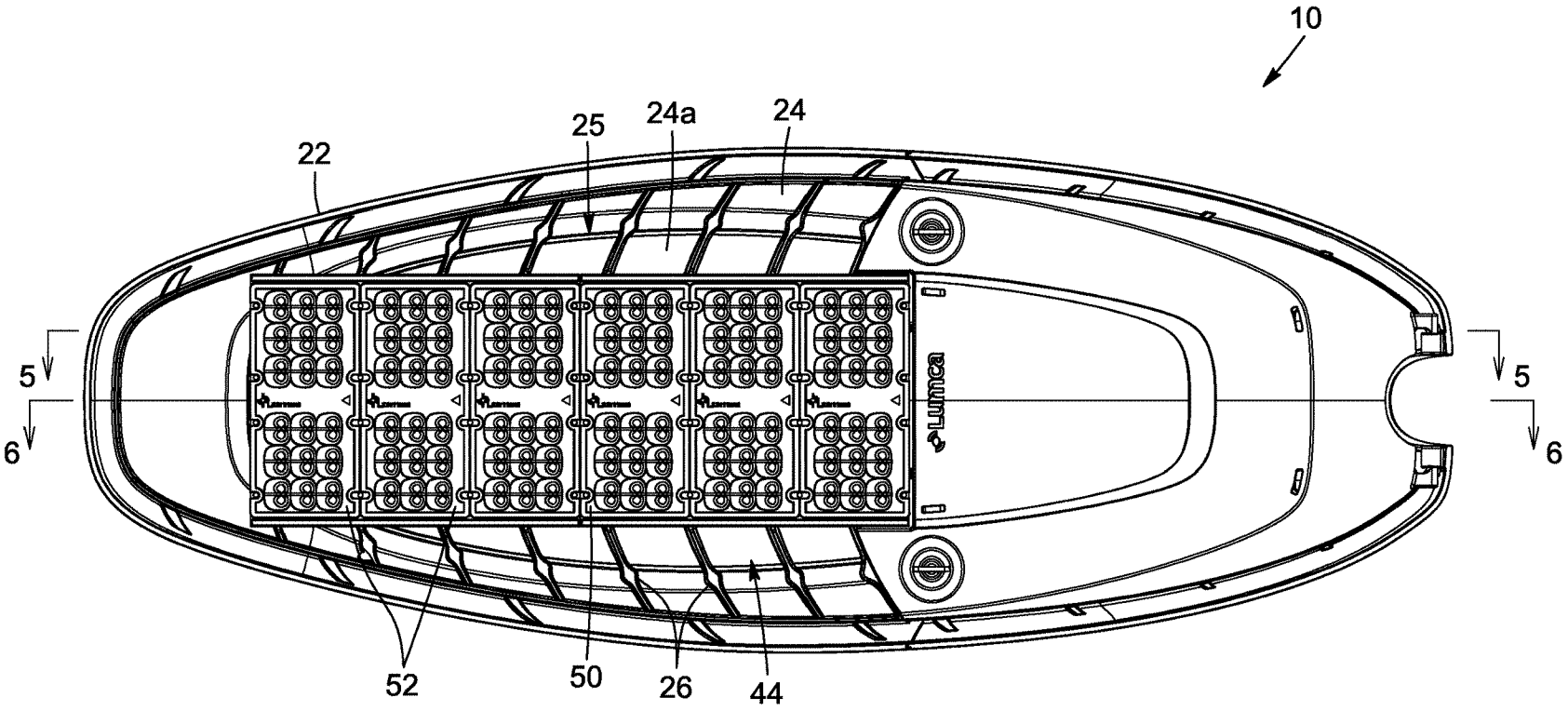
FIG. 3 is a bottom plan view of the LED lighting system of FIG. 1.
Figure 4:
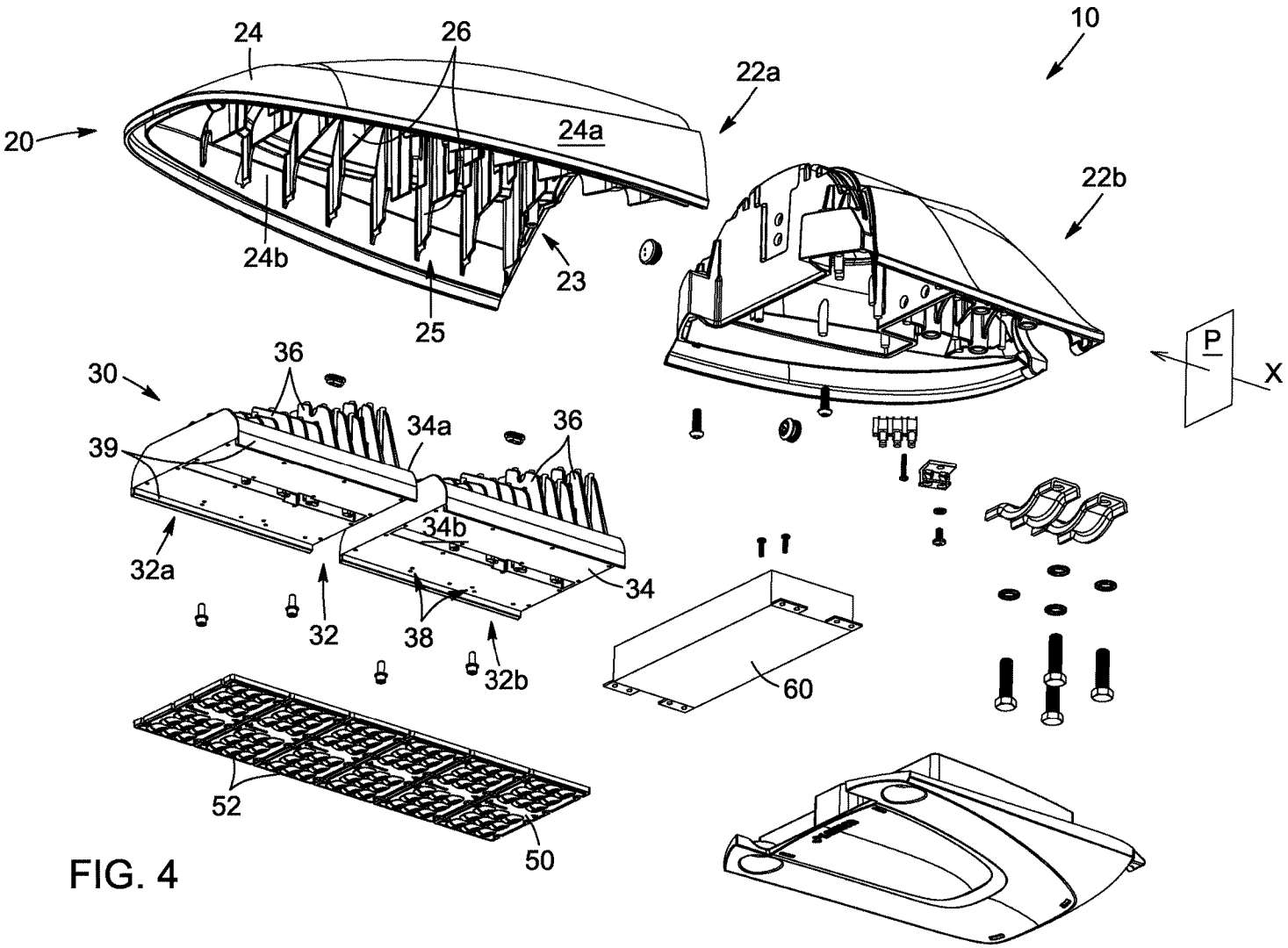
FIG. 4 is an exploded view of the LED lighting system of FIG. 1.

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the LED lighting fixture and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the LED lighting fixture, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Referring generally to FIGS. 1 to 6, there is provided a LED lighting fixture 10, in accordance with an embodiment. In the embodiment shown, the LED lighting fixture 10 is sized and shaped to be used as an outdoor lighting fixture such as, for example and without being limitative, a street lighting fixture, a roadway lighting fixture, a parking lot lighting fixture, a lighting projector, a flood light, a wall pack light, a bollard light, a light column or the like. One skilled in the art will understand that, in alternative embodiments, the LED lighting fixture can also be sized and shaped to be adapted to lighting purposes other than the ones mentioned above.

The LED lighting fixture 10 includes a housing 22 forming a protective outer shell for the lighting fixture 10. In the embodiment shown, the housing 22 is divided into two separable compartments: a LED receiving compartment 22*a* and a driver compartment 22*b*. As will be described in more details below, the LED receiving compartment 22*a* is configured to receive a LED assembly 50 while the driver compartment 22*a* is configured to receive at least one electronic LED driver 60 and/or other electronics required for powering and/or operating the LED assembly 50.

In the embodiment shown, to provide increased heat management of the LED lighting fixture 10, the LED receiving compartment 22*a* is substantially heat insulated from the driver compartment 22*b*. The purpose of the two separable compartments 22*a*, 22*b* is to substantially heat isolate the at least one electronic LED driver 60 and the additional electronics needed for powering and/or operating the LED assembly 50, from the LED assembly 50, and thereby maintain the at least one electronic LED driver 60 and the additional electronics in a cooler functioning environment. One skilled in the art will understand that, in an alternative embodiment (not shown), the housing 22 could however include a single compartment configured to receive both the LED assembly 50 and the at least one electronic LED driver 60 and/or other electronics.

The LED lighting fixture 10 also includes a LED support 32 engageable with the housing 22, in the LED receiving compartment 22*a* thereof, and the LED assembly 50 engageable with the LED support 32.

One skilled in the art will understand that the LED assembly 50 includes at least one LED module 52. In the embodiment shown, the LED assembly 50 includes a plurality of LED modules 52 combined to define the LED assembly 50. In the embodiment shown, each one of the LED modules 52 is substantially rectangular, but one skilled in the art will understand that, in alternative embodiments (not shown), the LED modules 52 could have different shape and size than the LED modules of the embodiment shown. LED modules are well known in the art and it will be understood that known LED modules can be used in the LED assembly 50 of the LED lighting fixture 10.

In the embodiment shown, in the LED receiving compartment 22*a*, the housing 22 includes a closed outer wall 24 defining a housing cavity 23 having a cavity inlet 25 and a plurality of first heat conductive projections 26 extending inwardly into the housing cavity 23 from the closed outer wall 24. In an embodiment, the plurality of first heat conductive projections 26 extending inwardly from the closed outer wall 24 are integral therewith. However, one skilled in the art will understand that, in an alternative embodiment (not shown), the heat conductive projections 26 could be connected thereto through known connecting means or methods, such as, for example and without being limitative, welding, brazing, soldering, riveting, screwing or the like, to allow thermal exchange therebetween, without being integral.

In the embodiment shown, the closed outer wall 24 of the housing 22 has a curved (or curvilinear) shape to define the housing cavity 23. In the embodiment shown, the closed outer wall 24 has a concave inner wall surface 24*a* delimiting the housing cavity 23 and an opposed convex outer wall surface 24*b*. The plurality of first heat conductive projections 26 project from the inner wall surface 24*a* of the closed outer wall 24. In an embodiment, the plurality of first heat conductive projections 26 are spaced apart from one another and extend substantially parallel to one another. The combination of the closed outer wall 24 and the plurality of first heat conductive projections 26 projecting inwardly therefrom, together define a first heat sink section 20 of the LED lighting fixture 10.

The closed outer wall 24 and the projections 26 are made of high thermal conductivity material such as, for example and without being limitative, steel, copper, aluminum alloy or other high thermal conductivity metal or metal alloy, or any other material having high thermal conductivity properties. In the course of the present document, the term "high thermal conductivity material" is used to refer to material having a thermal conductivity of at least about 50 W/m·K and preferably of at least about 80 W/m·K.

In the embodiment shown, the inner wall surface 24*a* of the outer wall 24 faces downwardly (i.e. generally towards the ground) while the outer wall surface 24*b* of the outer wall 24 faces upwardly (i.e. generally towards the sky), when the LED lighting fixture 10 is in an operational configuration (i.e. in the position generally used for the LED lighting fixture 10 when operating and as shown in the appended Figures).

Moreover, in an embodiment, the housing 22 of the LED lighting fixture 10 extends longitudinally along a longitudinal axis X. In the embodiment shown, the first heat conductive projections 26 projecting inwardly from the inner surface 24*a* of the closed outer wall 24 (i.e. the heat conductive projections 26 of the first heat sink section 20) are each substantially aligned with a lateral plane P being defined substantially perpendicularly to the longitudinal axis X.

In an embodiment, the housing 22 further includes mechanical fastener receiving sockets 28. The mechanical fastener receiving sockets 28 are positioned and configured to receive therein mechanical fasteners, such as screws or the like, to engage and secure the LED support 32 to the housing 22, as will be described in more details below. In other words, the housing 22 is configured to allow the LED support 32 to be engageable and securable thereto.

In the embodiment shown, the LED support 32 includes a LED engaging wall 34 and a plurality of second heat conductive projections 36 extending inwardly in the housing cavity 23, when the LED support 32 and the housing 22 are engaged with one another. More specifically, the LED engaging wall 34 includes an inner wall surface 34*a* and an opposed outer wall surface (or LED engaging surface) 34*b*, with the plurality of second heat conductive projections 36 projecting from the inner wall surface 34*a* of the LED engaging wall 34. In an embodiment, the plurality of second heat conductive projections 36 extending inwardly from the LED engaging wall 34 are integral therewith. However, one skilled in the art will once again understand that, in an alternative embodiment (not shown), the heat conductive projections 36 could be connected thereto through known connecting means or methods, such as, for example and without being limitative, welding, brazing, soldering, riveting, screwing or the like, to allow thermal exchange therebetween, without being integral.

In an embodiment, the plurality of second heat conductive projections 36 are once again spaced apart from one another and extend substantially parallel to one another. The LED support 32 including the combination of the LED engaging wall 34 and the plurality of second heat conductive projections 36 extending inwardly therefrom defines a second heat sink section 30 of the LED lighting fixture 10.

Once again, the LED engaging wall 34 and the projections 36 are made of high thermal conductivity material such as, for example and without being limitative, steel, copper, aluminum alloy or other high thermal conductivity metal or metal alloy, or any other material having high thermal conductivity properties.

In the embodiment shown, the inner wall surface 34*a* of the LED engaging wall 34 of the LED support 32 faces upwardly (i.e. generally towards the sky) while the LED engaging surface 34*b* of the LED engaging wall 34 faces downwardly (i.e. generally towards the ground), when the LED lighting fixture 10 is in the operational configuration.

One skilled in the art will however understand that, in alternative embodiments (not shown), different orientations could be provided. For example and without being limitative, at least one of the housing 22 or the LED support 32 could be substantially horizontal or angled with regard to a vertical configuration, with the corresponding one of the first heat conductive projections 26 or the second heat conductive projections 36 being substantially horizontal or angled with regard to a vertical configuration, in the operational configuration.

In the embodiment shown, the LED support 32 includes two adjacent LED support sections 32*a*, 32*b*, together defining the LED support 32. In an embodiment, the two adjacent LED support sections 32*a*, 32*b* can be engageable to one another or be spaced apart from one another. One skilled in the art will understand that, in alternative embodiments (not shown), the LED support 32 could include more than two sections or a single section.

Similarly to the housing 22, the LED support 32 of the LED lighting fixture 10 extends longitudinally along the longitudinal axis X. In the embodiment shown, the second heat conductive projections 36 projecting inwardly from the inner surface 34*a* of the LED engaging wall 34 (i.e. the second heat conductive projections 36 of the second heat sink section 30) are also each substantially aligned with the lateral plane P being defined substantially perpendicularly to the longitudinal axis X.

The LED support 32 is also configured to receive and retain the LED assembly 50 thereagainst. In other words, the LED assembly 50 is connectable to the LED support 32, with the LED support 32 being configured to allow the LED assembly to be engageable and securable thereto. In the embodiment shown, when the LED assembly 50 is received and retained against the LED support 32, the LED assembly 50 is engaged with the outer LED engaging surface 34*b* of the LED engaging wall 34, such that the LED assembly 50 and the LED engaging wall 34 are in thermal engagement with one another. In the embodiment shown, the LED support 32 includes a plurality of threaded holes 38 in the LED engaging surface 34*b* of the LED engaging wall 34, for receiving mechanical fasteners, such as bolts, screws or the like, used for securing the LED assembly 50 to the LED support 32. In an embodiment, the LED support 32 also includes supporting side walls 39 spaced apart from one another and extending from the LED engaging surface 34*b* of the LED engaging wall 34, at opposed ends thereof. One skilled in the art will understand that, in alternative embodiments (not shown), the LED assembly 50 could be engageable with the LED support 32 and/or be securable thereto using means or method distinct from those of the embodiment shown, with the LED assembly 50 still being supported by the LED support 32 and being in thermal engagement with the LED engaging wall 34 thereof.

Figure 6:
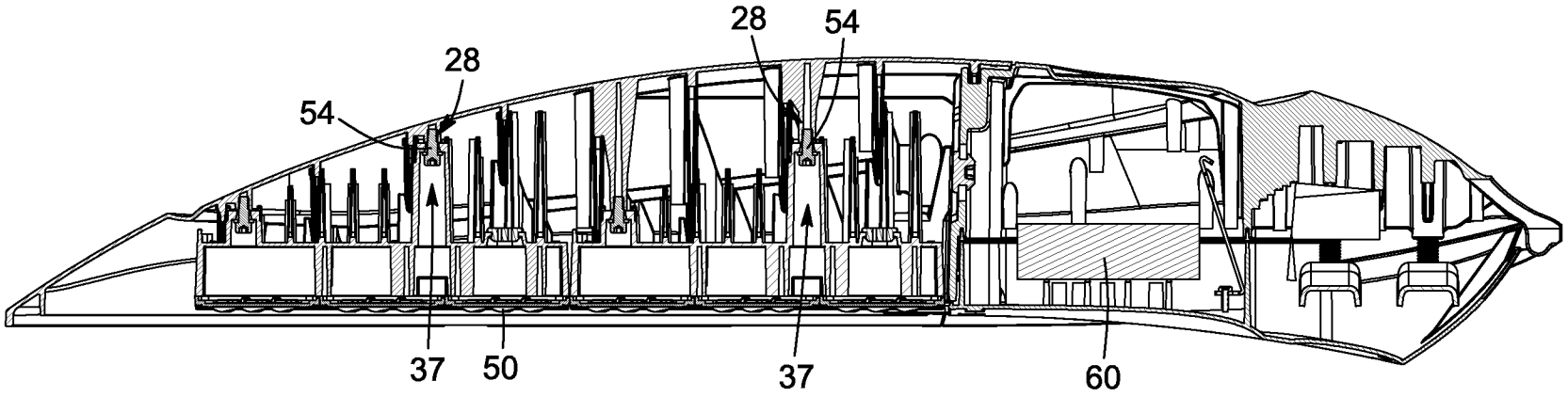
FIG. 6 is a cross sectional view of the LED lighting system of FIG. 1, taken along line 6-6 in FIG. 3.

As can be seen more clearly in FIG. 6, the LED support 32 is engageable with the housing 22. In the embodiment shown, the LED support 32 includes mechanical fastening receiving bores 37 substantially aligned (or substantially in register) with the above mentioned mechanical fastener receiving sockets 28 of the LED receiving compartment 22*a* of the housing 22, when the LED support 32 is inserted into the housing cavity 23 of the housing 22 and engaged with the housing 22. Hence, in an embodiment, to engage and secure the LED support 32 to the housing 22, mechanical fasteners 54, such as screws, bolts, or the like can be inserted into each mechanical fastening receiving bore 37 of the LED support 32 and engaged into the corresponding mechanical fastener receiving socket 28 of the LED receiving compartment 22*a* of the housing 22. One skilled in the art will understand that, in alternative embodiments (not shown), the LED support 32 can also be engageable with the housing 22 through a different mechanism or assembly. For example and without being limitative, in an embodiment (not shown), the LED support 32 can be engageable with the housing 22 through clipping, press fitting or other means or methods allowing secure engagement therebetween.

Figure 5:
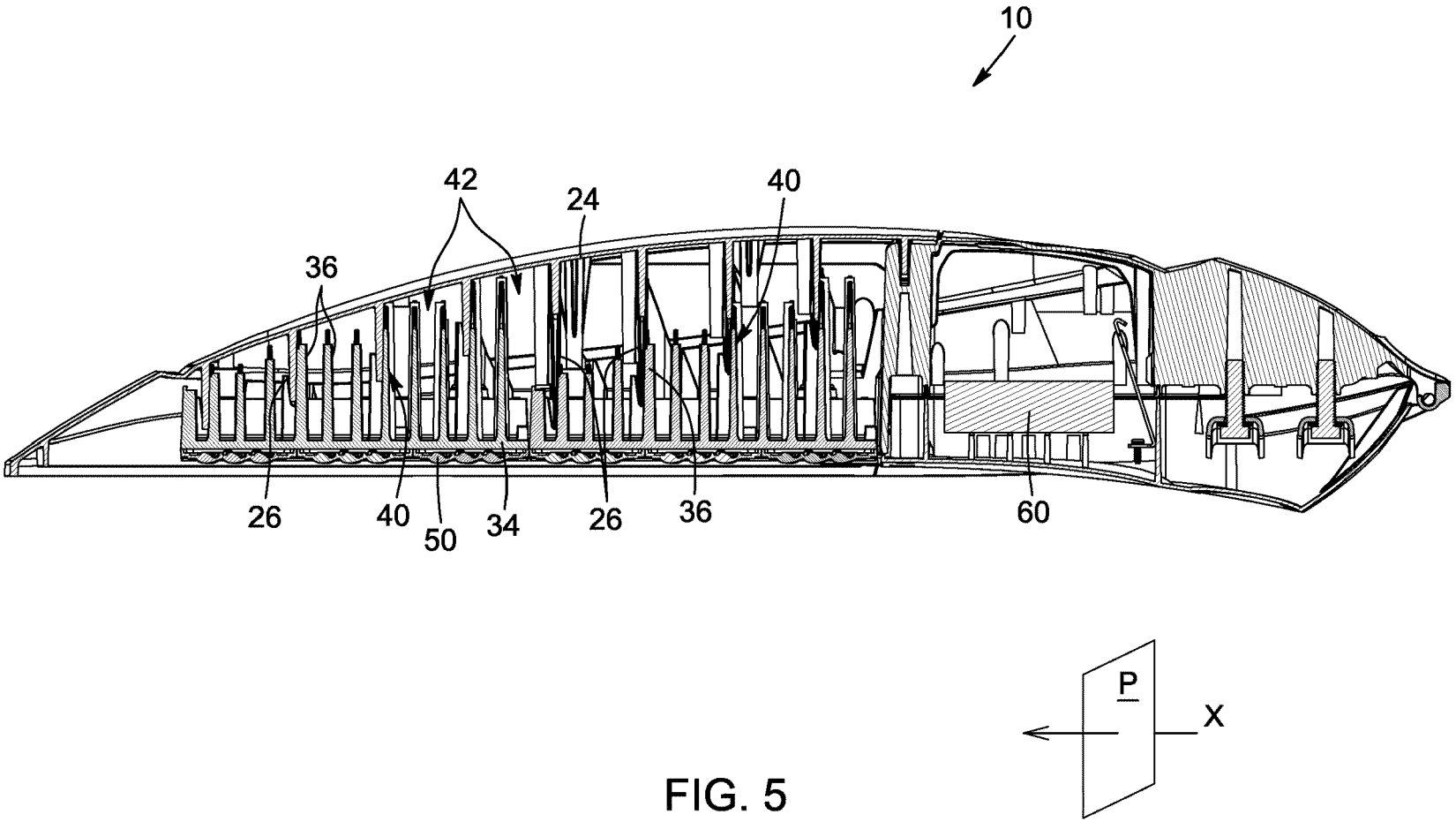
FIG. 5 is a cross sectional view of the LED lighting system of FIG. 1, taken along line 5-5 in FIG. 3.

Referring to FIG. 5, when the LED support 32 is engaged with the housing 22, at least one of the first heat conductive projections 26 projecting inwardly from the inner surface 24*a* of the closed outer wall 24 of the housing 22 is in thermal conduction engagement with a corresponding one of the second heat conductive projections 36 projecting inwardly from the inner surface 34*a* of the LED engaging wall 34 of the LED support 32. In other words, when the LED support 32 is engaged with the housing 22, at least one of the first heat conductive projections 26 projecting inwardly from the inner surface 24*a* of the closed outer wall 24 of the housing 22 (referred above as the first heat conductive projections 26 of the housing 22 of the first heat sink section 20) is physically connected to the second heat conductive projections 36 projecting inwardly from the inner surface 34*a* of the LED engaging wall 34 of the LED support 32 (referred below as the second heat conductive projections 36 of the LED support 32 or the second heat sink section 30), to define a thermal bridge 40 between the LED engaging wall 34 of the LED support 32 and the closed outer wall 24 of the housing 22. As will be easily understood by one skilled in the art, the thermal bridge 40 allows heat generated by the LED assembly 50 to be transferred to the outer wall 24 of the housing 22, by heat conduction, for subsequent dissipation in the surrounding air. In other words, at least one of the first heat conductive projections 26 of the first heat sink section 20 is connectable to a corresponding one of the second heat conductive projections 36 of the second heat sink section 30, such that the first heat sink section 20 and second heat sink section 30 define the thermal bridge allowing transfer of the heat generated by the LED assembly 50 by head conduction, for dissipation thereof.

In the present description, terms such as "physically connect" "physically contact", "physically engage" or variations thereof are understood to refer to direct physical engagement between the components or physical contact through an intermediary. For example and without being limitative, in an embodiment (not shown), a heat conductive paste or another heat conductive intermediate layer can be provided between the at least one of the first heat conductive projections 26 and the corresponding one of the second heat conductive projections 36, with the projections 26, 36, still being considered "physically connected", in "physical contact", "physically engaged" or the like.

In the embodiment shown, there is less first heat conductive projections 26 than second heat conductive projections 36 and each one of the first heat conductive projections 26 is connected with a corresponding one of the second heat conductive projections 36, with some of the second heat conductive projections 36 not being in contact with any of the first heat conductive projections 26. One skilled in the art will however understand that, in alternative embodiments (not shown), different amount of first heat conductive projections 26 and/or second heat conductive projections 36 could be provided. The amount, size and shape of the first heat conductive projections 26 and second heat conductive projections 36 could lead to a different amount of first heat conductive projections 26 and/or second heat conductive projections 36 being free from contact with a corresponding one of the first heat conductive projections 26 or second heat conductive projections 36, or all of the first heat conductive projections 26 and second heat conductive projections 36 being in contact with a corresponding one of the first heat conductive projections 26 and second heat conductive projections 36.

In other words, in an embodiment and as can be seen in FIGS. 1 to 6, only a subset of the second heat conductive projections 36 of the second heat sink section 30 can physically contact with a corresponding one of the first heat conductive projections 26 of the first heat sink section 20, to define the thermal bridge 40. Conversely, in an alternative embodiment (not shown), only a subset of the first heat conductive projections 26 of the first heat sink section 20 can physically contact with a corresponding one of the second heat conductive projections 36 of the second heat sink section 30 or all of the first heat conductive projections 26 of the first heat sink section 20 can physically contact with a corresponding one of the second heat conductive projections 36 of the second heat sink section 30 and vice-versa, to define the thermal bridge 40.

Again referring to FIGS. 1 to 6, in an embodiment, the first heat conductive projections 26 of the housing 22 and the second heat conductive projections 36 of the LED support 32 are sized and shaped such that at least a section thereof overlap when the LED support 32 is engaged with the housing 22 (i.e. when the first heat sink section 20 is engaged with the second heat sink section 30). In the embodiment shown, the first heat conductive projections 26 of the housing 22 are connected to the second heat conductive projections 36 of the LED support 32 by lateral surfaces of the corresponding ones of the first heat conductive projections 26 and the second heat conductive projections 36 being in contact with one another, in at least a portion of the overlapping sections thereof.

In an embodiment, each one of the first heat conductive projections 26 of the first heat sink section 20 extends along substantially an entire width of the inner surface 24*a* of the outer wall 24 of the housing 22 (i.e. it projects from the inner surface 24*a* of the outer wall 24 of the housing 22 along substantially the entire distance between a first lateral edge of the housing cavity 23 to an opposed lateral edge thereof). Similarly, each one of the second heat conductive projections 36 of the second heat sink section 30 extends along substantially an entire width of the inner surface 34*a* of the LED engaging wall 34 of the LED support 32 (i.e. it projects from the inner surface 34*a* of the LED engaging wall 34 of the LED support 32 along substantially the entire distance between a first edge of the LED engaging wall 34 to an opposed edge thereof). Such a configuration favors the heat conduction between the LED engaging wall 34 of the LED support 32 and the outer wall 24 of the housing 22 when the first heat conductive projections 26 of the first heat sink section 20 are physically engaged with the second heat conductive projections 36 of the second heat sink section 30, by maximising the contact surface between the projections 26, 36 and the corresponding one of the outer wall 24 and the LED engaging wall 34.

In the embodiment shown, the heat conductive projections 26 of the first heat sink section 20 and the second heat conductive projections 36 of the second heat sink section 30 are wedge shaped (i.e. the projections 26, 36 are thicker at their base than at their extremity) to, once again, favor heat conduction between the projections 26, 36 and the corresponding one of the outer wall 24 of the housing 22 and the LED engaging wall 34 of the LED support 32. One skilled in the art will however understand that, in an alternative embodiment (not shown), the heat conductive projections 26 of the first heat sink section 20 and the second heat conductive projections 36 of the second heat sink section 30 could be shaped differently, such as, without being limitative, have a substantially constant thickness.

In the embodiment shown, the first heat conductive projections 26 and the second heat conductive projections 36 are elongated, thin stripes of material, thereby defining fins, but one skilled in the art will understand that, in an alternative embodiment (not shown), the first heat conductive projections 26 and/or the second heat conductive projections 36 could be shaped differently. For example and without being limitative, the first heat conductive projections 26 and/or the second heat conductive projections 36 could be rectangular projections, cylindrical projections, triangular projections or any other shape allowing engagement therebetween.

In the embodiment shown, air circulation channels 42 are defined between connected ones of the first heat conductive projections 26 of the housing 22 and the second heat conductive projections 36 of the LED support 32, when the LED support 32 is engaged with the housing 22 (i.e. when the first heat sink section 20 is engaged with the second heat sink section 30). In the present description, the term "connected heat conductive projections" refers to a pair of heat conductive projections including a first heat conductive projection 26 physically connected with a second heat conductive projection 36, when the first and second heat sink sections 20, 30 are engaged together. In an embodiment, each one of the air circulation channels 42 extends substantially between the inner surface 34*a* of the LED engaging wall 34 of the LED support 32 and the inner surface 24*a* of the outer wall 24 of the housing 22 and the spaced apart connected ones of the first heat conductive projections 26 and second heat conductive projections 36, when the LED support 32 is engaged with the housing 22. The air circulation channels 42 allow air circulation therein. Hence, the air circulation channels 42, allow transfer of the heat generated by the LED assembly 50 to the outer wall 24 of the housing 22 by radiation. It will be understood that, the first heat conductive projections 26 and/or the second heat conductive projections 36 which are free from contact with a corresponding one of the first heat conductive projections 26 or second heat conductive projections 36 can extend into a corresponding one of the air circulation channels 42.

In an embodiment, the surface area of the LED engaging wall 34 of the LED support 32 and the LED assembly 50 connectable therewith is smaller than the surface area of the cavity inlet 25 of the housing 22. Therefore, the LED lighting fixture 10 includes at least one airflow port 44 at least partially surrounding the LED engaging wall 34 of the LED support 32 and the corresponding LED assembly 50. The at least one airflow port 44 allows air to flow in and out of the housing cavity 23 through the air circulation channels 42. In such an embodiment, heat dissipation can also occur through the first heat conductive projections 26 of the first heat sink section 20 and/or the second heat conductive projections 36 of the second heat sink section 30, as a result of the air circulation through the air circulation channels 42.

Figure 7A:
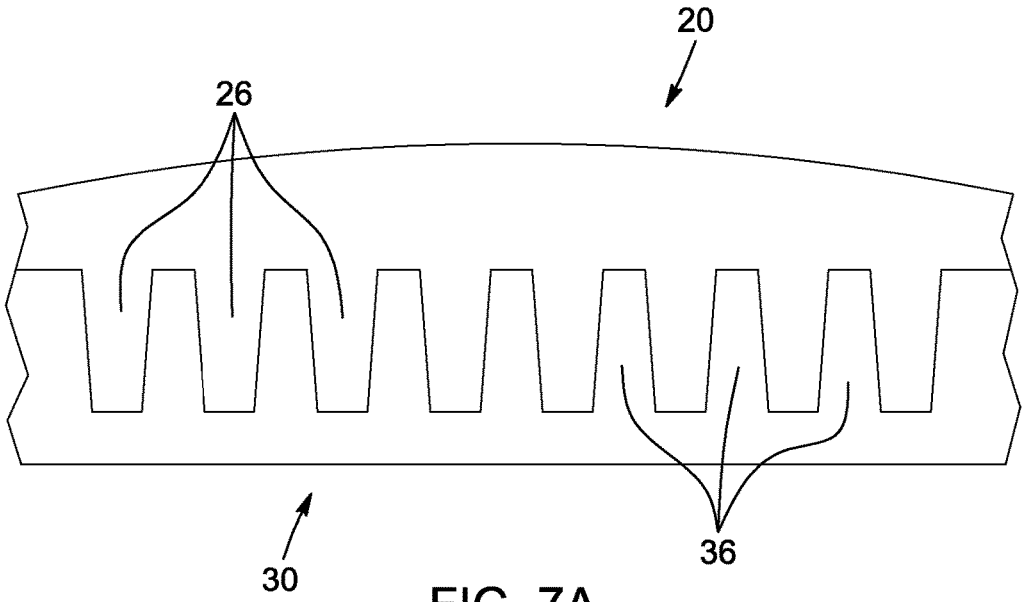
FIGS. 7A and 7B are schematic cross section representations of portions of a first heat sink section and a second heat sink section, including alternative projection designs, in accordance with an embodiment where no air circulation channel is defined between connected ones of the first heat conductive projections of the first heat sink section and the second heat conductive projections of the second heat sink section, FIG. 7A showing the projections in complete contact and FIG. 7B showing the projections in partial contact.
Figure 7B:
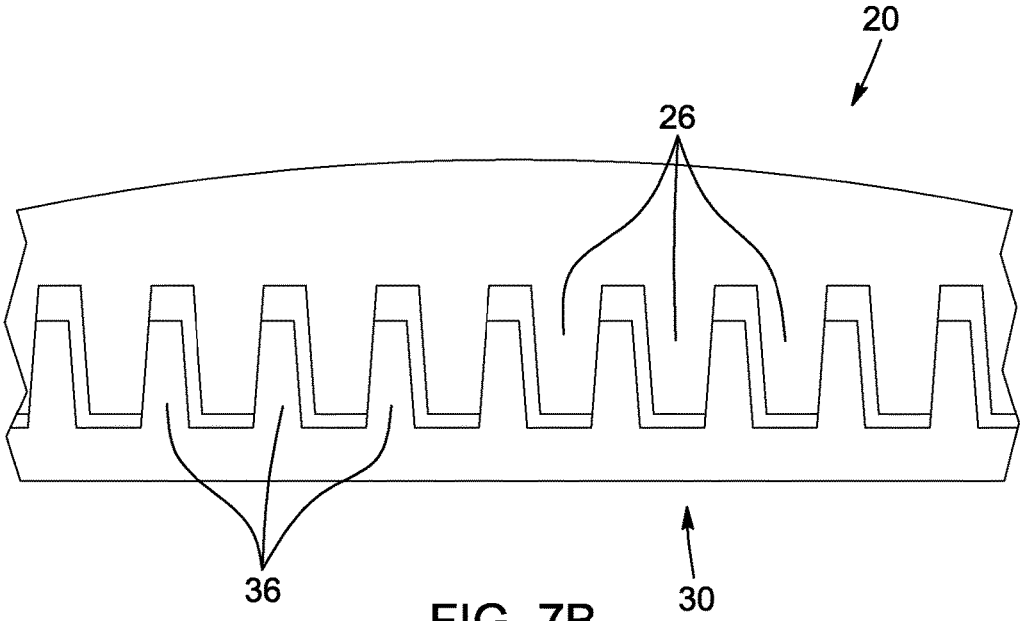

Referring to FIGS. 7A and 7B showing a schematic cross section representation of a portion of the first heat sink section 20 and the second heat sink section 30, with alternative design for the projections 26, 36 of the first heat sink 20 and the second heat sink 30, one skilled in the art will understand that, in an alternative embodiment, the LED lighting fixture 10 can be free of air circulation channels 42 and/or airflow port 44. For example and without being limitative, in the embodiment shown in FIGS. 7A and 7B, the first heat conductive projections 26 of the first heat sink section 20 and the second heat conductive projections 36 of the second heat sink section 30 are wide enough such that there is substantially no free space defined between the engaged ones of the first heat conductive projections 26 of the first heat sink section 20 and second heat conductive projections 36 of the second heat sink section 30, when the LED support 32 is engaged with the housing 22. In another alternative embodiment (not shown), the LED engaging wall 34 of the LED support could be sized and shaped to substantially close the cavity inlet 25 of the housing 22, thereby resulting in no airflow port 44.

In view of the above, the LED lighting fixture 10 is designed to prevent overheating of the LED assembly 50 by allowing heat transfer from the LED assembly 50 to the outer wall 24 of the housing. The LED lighting fixture 10 also provides physical protection of the LED assembly 50 and prevents water, dust and debris to accumulate into the housing 22, given the closed upper casing design provided by the closed outer wall 24 of the housing 22. The two-part heat sink, including the first heat sink section 20 and the second heat sink section 30 also allows greater flexibility in design of the components in order to reach desired aesthetic standards for the LED lighting fixture 10.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A LED lighting fixture comprising:

a first heat sink section made of high thermal conductivity material, the first heat sink section comprising:

a closed outer wall defining a housing cavity and having an inner surface; and a plurality of first heat sink projections projecting inwardly into the housing cavity from the inner surface of the closed outer wall;

a second heat sink section made of high thermal conductivity material and engageable with the first heat sink section, the second heat sink section comprising:

a LED support including a LED engaging wall having an inner surface; and a plurality of second heat sink projections projecting from the inner surface of the LED engaging wall of the LED support, at least one of the plurality of second heat sink projections physically engaging a corresponding one of the plurality of first heat sink projections to define a thermal bridge therebetween, when the first heat sink section and the second heat sink section are engaged with one another;

a LED assembly engageable with the second heat sink section, the LED assembly being in thermal engagement with the LED engaging wall of the second heat sink section when engaged with the second heat sink section.

2. The LED lighting fixture of claim 1, wherein air circulation channels are defined between connected ones of the plurality of first heat sink projections and the plurality of second heat sink projections, when the first heat sink section and the second heat sink section are engaged with one another.

3. The LED lighting fixture of claim 2, further comprising at least one airflow port at least partially surrounding the LED support, when the first heat sink section and the second heat sink section are engaged with one another, the at least one airflow port allowing airflow through the air circulation channels.

4. The LED lighting fixture of claim 1, wherein the first heat sink section and the second heat sink section extend longitudinally along a longitudinal axis and wherein the plurality of first heat sink projections and the plurality of second heat sink projections are each substantially aligned with a lateral plane being defined substantially perpendicular to the longitudinal axis.

5. The LED lighting fixture of claim 4, wherein the closed outer wall of the first heat sink section has a width and wherein each one of the plurality of first heat sink projections projects from the inner surface of the closed outer wall along substantially the entire width thereof.

6. The LED lighting fixture of claim 4, wherein the LED engaging wall of the LED support of the second heat sink section has a width and wherein each one of the plurality of second heat sink projections projects from the inner surface of the LED engaging wall along substantially the entire width thereof.

7. The LED lighting fixture of claim 1, wherein at least a section of the plurality of first heat sink projections and the plurality of second heat sink projections overlap over an overlapping section, when the first heat sink section and the second heat sink section are engaged with one another.

8. The LED lighting fixture of claim 7, wherein the at least one of the plurality of second heat sink projections is connectable to the corresponding one of the plurality of first heat sink projections along a lateral surface of at least a portion of the overlapping section.

9. The LED lighting fixture of claim 1, wherein each one of the plurality of first heat sink projections is connectable to a corresponding one of the plurality of second heat sink projections, to define the thermal bridge between the first heat sink section and the second heat sink section, when the first heat sink section and the second heat sink section are engaged with one another.

10. A LED lighting fixture comprising:

a housing having a closed outer wall made of high thermal conductivity material and defining a housing cavity with a cavity inlet, the outer wall having an inner surface;

a plurality of first heat conductive projections projecting from the inner surface of the closed outer wall of the housing and into the housing cavity;

a LED support engageable with the housing, the LED support including a LED engaging wall made of high thermal conductivity material and having an inner surface and an outer surface;

a plurality of second heat conductive projections projecting from the inner surface of the LED engaging wall of the LED support, at least one of the plurality of second heat conductive projections being physically engageable with a corresponding one of the plurality of first heat conductive projections to define a thermal bridge between the closed outer wall of the housing and the LED engaging wall of the LED support, when the LED support is engaged with the housing; and a LED assembly engageable with the outer surface of the LED engaging wall of the LED support, the LED assembly being in thermal connection with the LED support when engaged with the outer surface of the LED engaging wall of the LED support.

11. The LED lighting fixture of claim 10, wherein air circulation channels are defined between the connected ones of the plurality of first heat conductive projections and the plurality of second heat conductive projections, when the LED support is engaged with the housing.

12. The LED lighting fixture of claim 11, further comprising at least one airflow port at least partially surrounding the LED engaging wall of the LED support, when the LED support is engaged with the housing, the at least one airflow port allowing airflow through the air circulation channels.

13. The LED lighting fixture of claim 10, wherein the housing and the LED support extend longitudinally along a longitudinal axis and wherein the plurality of first heat conductive projections and the plurality of second heat conductive projections are each substantially aligned with a lateral plane being defined substantially perpendicularly to the longitudinal axis.

14. The LED lighting fixture of claim 13, wherein the closed outer wall of the housing has a width and wherein each one of the plurality of first heat conductive projections projects from the inner surface of the closed outer wall along substantially the entire width thereof.

15. The LED lighting fixture of claim 13, wherein the LED engaging wall of the LED support has a width and wherein each one of the plurality of second heat conductive projections projects from the inner surface of the LED engaging wall of the LED support along substantially the entire width thereof.

16. The LED lighting fixture of claim 10, wherein at least a section of the plurality of first heat conductive projections and the plurality of second heat conductive projections overlap over an overlapping section, when the LED support is engaged with the housing.

17. The LED lighting fixture of claim 16, wherein the at least one of the plurality of second heat conductive projections is connectable to the corresponding one of the plurality of first heat conductive projections along a lateral surface of at least a portion of the overlapping section.

18. The LED lighting fixture of claim 10, wherein each one of the plurality of first heat conductive projections is connectable to a corresponding one of the plurality of second heat conductive projections to define the thermal bridge between the closed outer wall of the housing and the LED engaging wall of the LED support, when the LED support is engaged with the housing.

* * * * *